United States Patent [19]

Lee et al.

[11] Patent Number: 5,005,451

[45] Date of Patent: Apr. 9, 1991

[54] ANGLE STOP INSTALLATION TOOL

[76] Inventors: Roger W. Lee, 20899 Maureen Way, Saratoga, Calif. 95070; Richard J. Ramirez, 1380 Navarro Dr., Sunnyvale, Calif. 94087

[21] Appl. No.: 526,890

[22] Filed: May 22, 1990

[51] Int. Cl.[5] ..... B25B 27/24

[52] U.S. Cl. ..... 81/487; 269/16; 269/909

[58] Field of Search ..... 81/13, 9.24, 176.1, 81/176.15, 176.2, 119, 121.1, 124.2, 487, 124.4, 488; 269/16, 909

[56] References Cited

U.S. PATENT DOCUMENTS 975,292 11/1910 Schramm ..... 81/119
2,611,949 9/1952 Wanamaker ..... 81/13
2,798,393 7/1957 Currin ..... 81/176.1
3,779,104 12/1973 Curry ..... 81/119
4,546,679 10/1985 Burghardt ..... 81/119
4,802,391 2/1989 Willhoite ..... 81/488

FOREIGN PATENT DOCUMENTS 551634 1/1923 France ..... 81/119

*Primary Examiner*—Roscoe V. Parker
*Attorney, Agent, or Firm*—Rosenblum, Parish & Bacigalupi

[57] ABSTRACT

An Angle Stop Installation Tool including a specially configured holder body having a cavity for matingly receiving the body of an angle stop valve and having passageways formed in the sides thereof through which forward, rear and lateral projections of the valve may protrude. An elongated handle of fixed or variable length extends from the lower side of the body.

11 Claims, 2 Drawing Sheets

ANGLE STOP INSTALLATION TOOL

BACKGROUND OF THE INVENTION

1. Field of the Invention

The present invention relates generally to hand tools used in the plumbing trade and more particularly to a special purpose tool for use by plumbers in the installation of plumbing fittings known as angle stop valves.

2. Description of the Prior Art

The classical mechanic's and plumber's lament is that for certain jobs he never seems to have enough hands to simultaneously hold parts and make connections thereto. One such situation that is encountered by plumbers in the installation of compression type angle stop valves used in kitchen and bathroom plumbing installations. The problem is that one must in tight quarters both hold the angle stop in position and prevent its rotation as a compression fitting is tightened. Conventionally this operation is accomplished using a crescent wrench, pliers or channel locks, none of which are particularly well suited for the job.

SUMMARY OF THE INVENTION

It is therefore a principle object of the present invention to provide a novel tool which can be used to both hold and prevent rotation of a single or multiple-way angle stop valve during its installation.

Briefly, a presently preferred embodiment of the present invention includes a specially configured holder body having a cavity for matingly receiving the body of an angle stop valve and having passageways formed in the sides thereof through which forward, rear and lateral projections of the valve may protrude. An elongated handle of fixed or variable length extends from the lower side of the body.

An important advantage of the present invention is that it allows the plumber to conveniently position and hold an angle stop valve during installation.

Another advantage of the present invention is that it is configured to mate with appropriate surfaces of the angle stop valve and requires no adjustment or application of clamping force to hold the valve.

Still another advantage of the present invention is that while holding the valve in place it provides open access to all nuts that must be tightened.

These and other objects and advantages of the present invention will no doubt become apparent to those skilled in the art after having read the following detailed description of a preferred embodiment illustrated in the several figures of the drawings.

IN THE DRAWING

DETAILED DESCRIPTION OF THE PREFERRED EMBODIMENT

Figure 1:
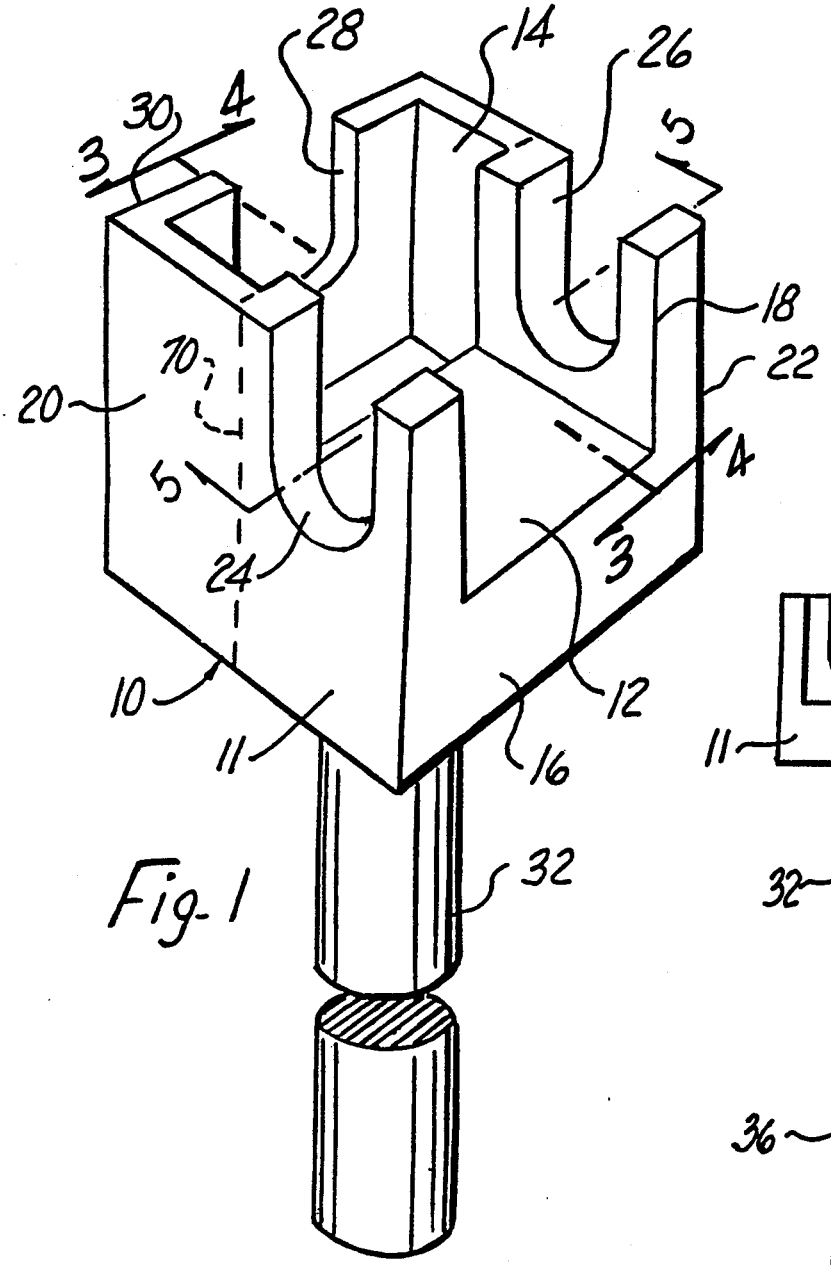
FIG. 1 is a perspective view showing an angle stop valve installation in accordance with the present invention.

Referring now to FIG. 1 of the drawing, an angle stop valve installation tool in accordance with the present invention is depicted at 10 which includes a generally cubically shaped valve body holder 11 having a first receptacle or cavity 12, with a first predetermined set of internal dimensions, and a second receptacle or cavity 14 having a second set of predetermined internal dimensions. Note that the floor of cavity 14 is stepped down relative to that of cavity 12. The wall 16 has a generally rectangular opening 18 defined by the intersection of the interior walls forming the cavity 12 and the exterior surface of wall 16. The left and right side walls 20 and 22 are provided with generally U-shaped openings 24 and 26 respectively extending into the cavity 12. A generally U-shaped opening 28 forms a passage extending through wall 30 and providing a passageway into the rear cavity 14. Affixed to the bottom of holder 11 is a handle 32 which is typically about six (6) inches in length, but as will described below may be extended to any desired length.

Figure 2:
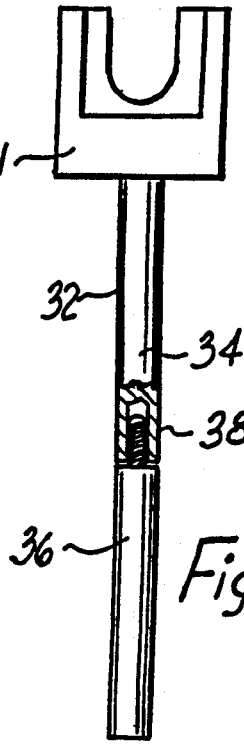
FIG. 2 is an elevational view of the tool shown in FIG. 1 partially broken to illustrate the extension handle feature.

In FIG. 2 handle 32 is depicted as being a 2-piece unit with the top end of an upper component 34 affixed to the bottom of holder 11 and having a lower component 36 threadably coupled to its lower end as indicated in broken section at 38. Alternatively a foldable or telescopic handle could be provided.

Figure 3:
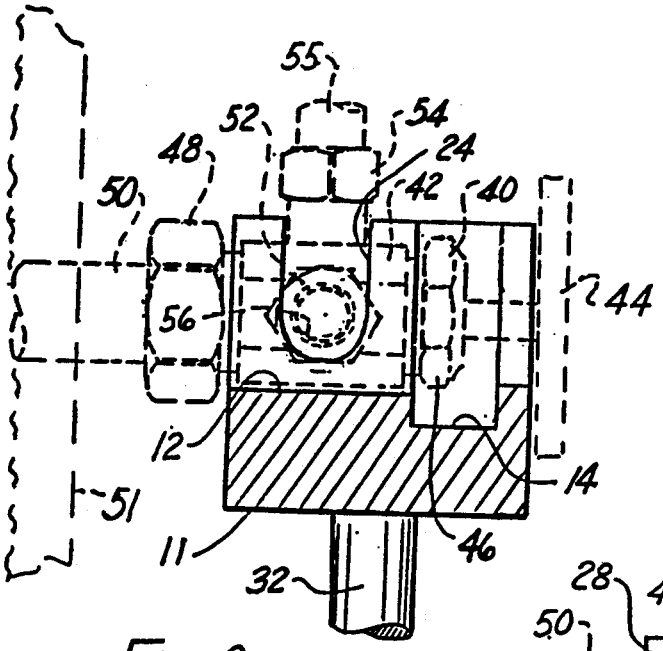
FIG. 3 is a transverse cross-section taken along the line 3—3 of FIG. 1.

Turning now to FIG. 3 of the drawing which is a cross-section taken along the line 3—3 of FIG. 1. An angle stop is depicted by the dashed lines 40 and is shown mated with the present invention as it would be held during installation to a water supply line 50. More particularly, a typical angle stop valve includes a body portion 42, a turn cock handle 44 and associated compression nut 46 at one end, a compression coupling nut 48 at the other end for connection to the pipe 50, and a pair of outlet couplings 52 and 54 at the side and the top respectively. Note that cavity 12 is dimensioned to engage the flat sides and bottom of body 42, while the dimensions of cavity 14 are selected so as not to interfere with nut 46, or if the tool is rotated 180 degrees (see FIG. 4), so as not to interfere with the rear compression nut 48. Note that with the tool in the position illustrated in FIG. 3 adequate clearance is provided between holder 11 and wall 51 to allow a wrench or pliers to engage and tighten nut 48.

With the tool in place around body 42 and with an outlet stem and compression nut 52 extending outside the body through one of U-shaped openings 24 and 26, and the upper outlet and compression nut 54 likewise unobstructed it is a simple matter to secure nuts 52 and 54 to outlet pipes 55 and 56 while holding handle 32.

Figure 4:
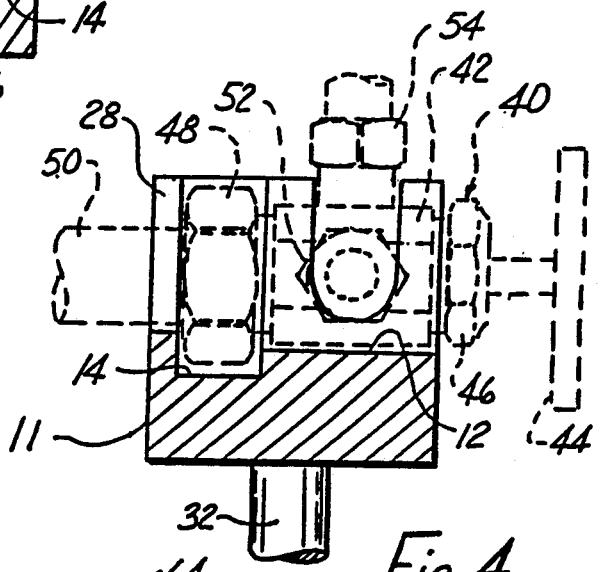
FIG. 4 is a transverse cross-section taken along the line 4—4 of FIG. 1.

Should it be necessary to remove or tighten the front nut 46, this could likewise be facilitated by rotating tool 10 180 degrees into the position illustrated in FIG. 4, such that nut 46 is positioned outside the tool and nut 40 is thus wrench accessible. Note that with tool 10 so orientated valve body 42 is again positioned within cavity 12 but nut 48 is disposed within cavity 14.

Figure 5:
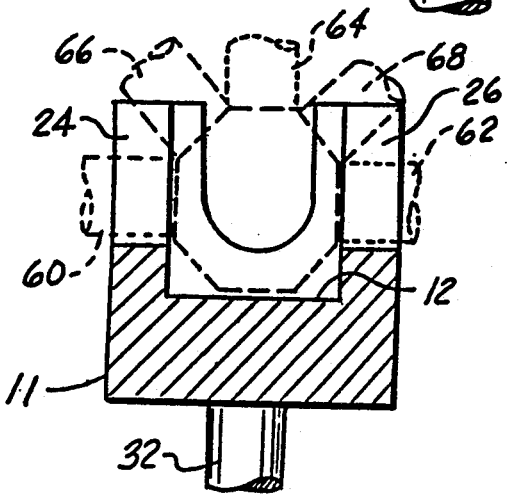
FIG. 5 is a transverse cross-section taken along the line 5—5 of FIG. 1.

Referring now to FIG. 5 which is a cross-section taken along the line 5—5 of FIG. 1, it will be noted that in addition to being able to accommodate left side, right side, vertical, two way and even three way angle stops, as suggested by the dashed lines 60, 62 and 64 respectively, the subject device can also accommodate single or dual outlet valves in which the outlets are angled as indicated by the dashed lines 66 and 68. In each case, the outlet fittings are accommodated by the U-shaped openings 24 and 26.

Although the preferred embodiment has been disclosed above in terms of a single preferred embodiment, it will be appreciated by those skilled in the art that such apparatus offers numerous advantages to those in the plumbing trade. It is also understood that various modifications and alternatives to the present invention will no doubt become apparent following a reading of the above disclosure. For example, for some applications it may be appropriate to eliminate that part of holder 11 to the rear of dashed line 70. This would result in a simple tuning fork like design with the U-shaped openings 24 and 26 being provided in each upstanding finger. It is therefore intended that the appended claims be interpreted as covering all such alterations and modifications as fall within the true spirit and scope of the invention.

We claim:

1. A tool for use in the installation of angle stop valves and the like, comprising:

holder means including a generally fork shaped member forming a receptacle for receiving the body of a valve, the facing inner walls of said fork shape member being adapted to engage flats on the outer walls of a valve body, said fork shaped member including first and second openings on opposite ends of said receptacle and at least one side opening through which an outlet stem of the engaged valve may be extended;

means forming a cavity proximate one of said opposite ends for receiving an unengaged part of the engaged valve; and means forming an elongated handle extending from the lower surface of said holder means.

2. A tool as recited in claim 1 wherein said fork shaped member has a second side opening on the side opposite said one side opening.

3. A tool as recited in claim 2 wherein said one side opening and said second side opening are generally U-shaped in configuration.

4. A tool as recited in claim 1 wherein said facing inner walls are spaced apart a distance slightly in excess of the outside dimension of the flats on the outer walls of the valve body to be engaged.

5. A tool as recited in claim 4 wherein said fork shaped member has a second side opening on the side opposite said one side opening.

6. A tool as recited in claim 5 wherein said one side opening and said second side opening are generally U-shaped in configuration.

7. A tool as recited in claim 1 wherein said first end opening is generally U-shaped in configuration.

8. A tool as recited in claim 1 wherein said second end opening is generally U-shaped in configuration but is wider than said first end opening.

9. A tool as recited in claim 3 wherein said first and second end openings are generally U-shaped in configuration but said first opening is narrower in width than said second opening.

10. A tool as recited in claim 6 wherein said first and second end openings are generally U-shaped in configuration but said first opening is narrower in width than said second opening.

11. A tool as recited in claim 1 wherein at least a part of said handle means is disconnectable.

* * * * *